United States Patent [19]

Young

[11] Patent Number: 4,650,073

[45] Date of Patent: Mar. 17, 1987

[54] ELECTRIC CABLE CONTAINER AND DISPENSER

[76] Inventor: David J. Young, Box 210, Hayes Dr., Yorktown Heights, N.Y. 10598

[21] Appl. No.: 764,104

[22] Filed: Aug. 9, 1985

[51] Int. Cl.[4] ..... B65D 85/04

[52] U.S. Cl. ..... 206/409; 206/389; 224/205

[58] Field of Search ..... 206/389, 395, 396, 409, 206/410; 150/52 R, 54 A, 54 B, 54 R; 229/175; 224/162, 205; 242/129, 129.5, 137.1, 146, 159, 170, 171, 1, 173

[56] References Cited

U.S. PATENT DOCUMENTS

| | | | |
|---|---|---|---|
| 193,033 | 7/1877 | Pierce | 242/137.1 |
| 1,990,135 | 2/1935 | Sato | 224/162 |
| 2,400,417 | 5/1946 | Hickey | 224/162 |
| 2,527,401 | 10/1950 | Daoust | 242/170 |
| 3,161,289 | 12/1964 | Leysen | 206/395 |
| 3,637,071 | 1/1972 | Jacobsen | 242/129 |
| 4,111,380 | 9/1978 | Heukroth | 242/137 |
| 4,312,448 | 1/1982 | Pelster | 206/409 |

FOREIGN PATENT DOCUMENTS

| | | | |
|---|---|---|---|
| 0102565 | 12/1937 | Australia | 242/137.1 |

*Primary Examiner*—William Price
*Assistant Examiner*—Jimmy G. Foster

[57] ABSTRACT

A container/dispenser is described for carrying and dispensing heavy electrical cable of the plastic or rubber-coated variety that is used in wiring homes and businesses. The container has unitary construction and is fabricated from a strong but flexible material, such as nylon, sailcloth, etc. A closeable opening is provided in one end for the insertion of a coil of electrical cable, and a central exit opening is provided for extruding cable from the center of the coil. A detachable and adjustable strap is included for carrying the container/dispenser. In operation, a preformed coil of electrical cable is inserted through the opening into the container/dispenser and is strand-wise extruded from the central exit opening. The opening through which the coil is placed in the container/dispenser can be closed, by means such as velcro fasteners.

6 Claims, 2 Drawing Figures

ELECTRIC CABLE CONTAINER AND DISPENSER

DESCRIPTION

1. Field of the Invention

This invention relates to a user-oriented container for carrying and dispensing heavy electrical cable, such as the plastic or rubber-coated cable used for electrical circuits in homes and businesses, and more particularly to such a container which is flexible and reuseable without any of the problems attendant to the presently used cardboard containers and dispensers.

2. Background Art

Electrical cable used by electricians to wire homes and businesses is well known in the art, and is typically comprised of heavy wires in a plastic coat. This cable is available in many sizes, commonly designated 12/2, 12/3, 14/2, 14/3, etc. These designations indicate the wire size and number of wires in a cable. For example, 12/2 and 12/3 indicate a size 12 wire which is encased as two wires or two wires and a ground wire, as is well known in the art. Such electrical cable is heavy and quite stiff, the plastic coated cable being approximately ½ inch in width.

The electrical cable described hereinabove is generally purchased as a coil packaged in a cardboard box having a generally rectangular cross-section. Electricians typically punch a hole in one face of the box and pull the cable from the inner part of the coil to the location where it is desired. Such coils can come in lengths up to approximately 250′ and, during the wiring job, these cardboard boxes are dragged around. During the actual wiring operation, the cardboard boxes quickly become broken and torn at various locations including the corners of the boxes. Also, it is quite common that the opening made for pay-out of the wire from the box becomes torn, allowing the wire to get caught in the tear and making continued pay-out impossible. Typically, the electrician must return to the location of the cardboard box in order to free the cables so that payout will continue.

Another problem with these boxes relates to their geometry and construction. Because the boxes have right angle corners and are of rigid construction, they often get caught on obstructions of the type typically found at construction sites. These boxes cannot be easily dragged around or moved without being damaged or being hung-up on the obstructions. Of course, when the box begins to break apart the wire cable often becomes disorganized and tangled, creating additional difficulties. In general, these boxes are flimsy and unreliable and do not lend themselves to easy pay out of hundreds of feet of heavy wire cable.

The prior art has provided many different containers for electrical cable and for other types of material which are dispensed from coils. Generally, it is the manufacturer which provides the container and dispenser, and these containers are often designed with respect to the problems of the manufacturer: to wit, protection of the contents during transportation to the ultimate user. The manufacturer is not particularly concerned with the problems that the user may encounter.

Examples of containers and dispensers provided by the manufacturers are found in the following U.S. Pat. Nos. 1,431,352; 3,637,071; 3,515,269; 3,809,333; 3,982,712; 2,596,970.

Typically, the structure of these containers is complex and often non-unitary (i.e., comprised of several pieces which must be joined), since it is usually desired to provide a technique for coiling the wire as well as for protecting it during transportation.

Aforementioned U.S. Pat. No. 1,431,352 describes a cardboard carton which is very similar to the cartons used by present day manufacturers to transport electrical cables to distributors. Unfortunately, it also exhibits the problems described above with respect to tearing, flimsiness, rigidity, and unreliable pay-out. This carton is not designed specifically for heavy electrical cables, and is instead intended to protect strands of cotton or other fabric. When this type of fabric is to be used, a covering on it is removed. However, this leaves the remainder of the conduit exposed without protection during subsequent transportation or when it is handled at a job site. For this reason, the carton of this patent was primarily designed to protect the fabric conduit. This is in contrast with the present invention, where it is a primary purpose to protect the reliable dispensing of heavy electrical cable.

The carton of U.S. Pat. No. 1,431,352 is comprised of a rigid cardboard material which must be sealed with a tape after it is assembled. After this, straps are provided for a handle. In the practice of using heavy electrical wire, an approach similar to that shown in this patent had been tried without success. In this approach, presently available cardboard containers for electrical cable were heavily taped to protect the corners of the rigid cartons. However, even when these cartons were reinforced, they did not prove adequate, since tearing and damage to the corners still occurred. Providing the reinforcing is, of course, an extra and costly step, and not one which is favored by electricians working in the field, who do not have time for such additional handling operations.

U.S. Pat. No. 3,637,071 describes a package which can be used for telephone cable, and is particularly adapted for use in the field, such as by military personnel. For this purpose, cable has to be coiled and dispensed, and then recoiled again when the military unit moves to a different location. A pre-wound coil is not present in this situation, so a mechanism must be provided for coiling and packaging the coiled telephone cable so that it can be moved. The package is comprised of three separate pieces, including two side members and an encompassing belt, all of which are laced together by a rope. Rigid side members also have to be used during the coiling operation in which the cable is wound onto a mandrel.

U.S. Pat. No. 3,515,269 describes a spool-type container for coiled wire. This container is rigid, and comprises two cylindrical pieces, a central one of which serves as a spool around which the wire coil is created. Rigid end pieces are provided to completely encompass the wire. Thus, the wire is protected during transportation by the manufacturer. The use of two cylindrical portions in the container permits the user to have access to both ends of the coil.

U.S. Pat. No. 3,809,333 also describes a wire container which is comprised of an inner spool around which the wire is formed, and an outer rigid cylindrical container. The spool portion of the container has a telescoping portion that can be used to bring a lid into and out of contact with the container. This allows the wire to be extracted from the container, but a central payout opening is not utilized.

U.S. Pat. No. 3,982,712 describes another spool-type container for wire in which a rigid feed-through tube is provided for the removal of wire wound around the spool. This complex structure is located in a rigid, square cornered container which can be made of plastic. If the container is plastic, then it is heat-sealed. This is not a reuseable container and is not readily adapted for ease of movement by an electrician at a job site. It is intended to be a more stationary package which is reuseable.

U.S. Pat. No. 2,596,970 describes a coil packaging technique in which a non-unitary structure comprising two side members has tabs thereon which are joined and circumscribed by multiple layers of tape. This package uses a central pay-out of wire, but is not readily reuseable in the field. In fact, it is the type which is provided by a manufacturer as it requires the coil to be preformed upon a spool. Once all the wire is dispensed, the package has to be broken apart and the binding tape removed. After that, it becomes non-reuseable.

As is apparent from the prior art, the particular problems encountered by electricians in the field have not been addressed. The prior art provides many different storage and transportation containers and different techniques for dispensing wire from these containers. However, no simple package and dispenser is provided whose design is specifically directed to the problems of the electrician who must use heavy electrical wire, and no reuseable dispenser is provided.

Accordingly, it is a primary object of the present invention to provide a reuseable container and dispenser for heavy electrical cable, such as plastic or rubber-coated cable.

It is another object of the present invention to provide a reuseable container and dispenser for electricians to use for carrying and dispensing heavy electrical cable, which container and dispenser can be used in the field without the usual problems of tearing and awkwardness of use encountered with rectangular cardboard containers.

It is another object of this invention to provide a flexible and reuseable container and dispenser for heavy electrical cable, which can be folded for easy storage when it is not being used.

It is a further object of the present invention to provide an improved container and dispenser for heavy electrical cable, such as plastic-coated cable, which is of unitary construction and readily adapted for the accommodation and dispensing of electrical cable therefrom.

It is a further object of the present invention to provide an improved container and dispenser for heavy electrical cable which is of unitary construction and has a shape that can accommodate varying lengths of electrical cable coils, said container being adaptable to the shape of the electrical cable coil and being characterized by the absence, in use, of rigid, right angle corners which tend to be damaged during use and which would easily be hung up on obstacles as the container is moved about at a job site.

It is another object of the present invention to provide an improved container and storage for dispensing heavy electrical cable, of the plastic-coated type, which is flexible and of unitary construction allowing its repeated use without damage thereto, and which can be accommodated with a strap holding means for carrying by the user.

It is another object of this invention to provide an improved container and dispenser for heavy electrical cable, which is reuseable and designed for simplicity of operation by the user thereof.

DISCLOSURE OF INVENTION

This invention is specifically directed to an improved container and dispenser for heavy electrical cable (wire), and particularly the well known plastic or rubber-coated electrical cable which comes in various wire sizes and lengths. It is particularly directed to such a container for transportation and payout of this electrical cable which comes in coil lengths of from 50 feet to 250 feet. Depending upon the wire gauge and the number of wires in the cable, these cables tend to be quite heavy and relatively stiff. Prior to the present invention, no good container and dispenser was provided for the electrician who must on a daily basis use these lengths of electrical cable. Accordingly, the present invention is directed to an improved container and dispenser which is reuseable and is fabricated from a strong and flexible material, such as nylon, sailcloth, etc.

This container and dispenser is of a unitary construction having a closeable opening for the easy insertion of a coil of electrical cable, and an opening which is generally circular for the central payout of cable from the enclosed coil. The general shape of the container is such that it can accommodate cable coils of varying coil tightness and will easily adapt to the varying lengths of coil that are to be used. An adjustable strap is also provided to allow a user to carry the container while dispensing cable therefrom. This is a particularly desireable feature when the user is working at an elevation, for example, while standing on a ladder.

In operation, the electrician merely breaks open the cardboard carton in which the cable coil is supplied from the manufacturer, and places the coil in the novel container/dispenser. Cable is removed from the dispenser through the reinforced exit hole so that cable payout is from the center of the coil. This, combined with the strong and flexible nature of the container material, allows dispensing without any tangling or disorganization of the cable in the container. Regardless of the length of coil left in the container, payout of the cable is protected by the container, so that any length of coil is easily carried and dispensed without any of the problems heretofore encountered.

These and other objects will be apparent from the following more particular description of the preferred embodiment.

BEST MODE FOR CARRYING OUT THE INVENTION

Figure 1:
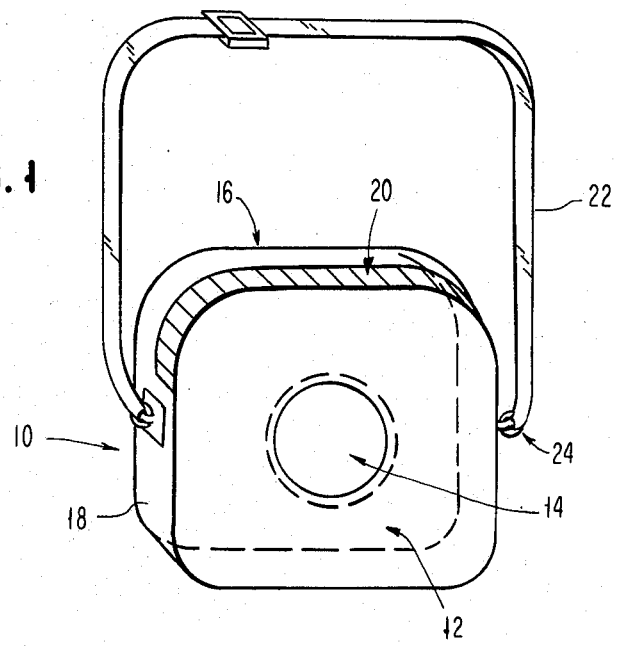
FIG. 1 is a schematic illustration of the electrical cable/ dispenser of the present invention.

In FIG. 1, the electrical cable container/dispenser 10 is comprised of a strong but flexible material, and has a unitary construction. Examples of suitable material for the container/dispenser 10 include nylon, sailcloth, canvas, etc. The material chosen must be flexible and sufficiently strong to support the stiff electrical cable and must be capable of being used over an extended period of time without deterioration, under adverse conditions of weather and rough usage.

Container/dispenser 10 includes a front face 12 into which a reinforced exit opening 14 is located for payout of cable from the inner portion of a coil placed within container 10. Container-dispenser 10 includes a rear face 16 and sides 18. A closeable opening is provided into container/dispenser 10 by using the velcro closure flap 20. This opening is used to insert and remove coils of wire from the interior of container 10. Although a velcro closure is shown, it will be appreciated that other types of closeable openings can be employed, such as those using zipper or closure snaps. However, in practice it has been found that the velcro closure tends to be easiest to use by an electrician who is constantly reusing container/dispenser 10.

The location of the opening into which coils of wire are inserted into container/dispenser 10 need not be on a side of the container/dispenser. However, a location on a side means that less stress is placed on the container/dispenser 10 during actual use, and for this reason provides more reliable operation. As an alternative, the front face 12 can be a flap which is opened and closed, as by a zipper or velcro closure, for the placement of a coil of electrical cable into container/dispenser 10. However, as noted, this approach is not as desireable from the standpoint of minimizing stress during useage of the container/dispenser 10.

A detachable, adjustable strap 22 is provided for carrying container/dispenser 10 during use. If desired, strap 22 can be removed by the use of detachable rings 24 on the strap and the container/dispenser 10.

Container/dispenser 10 is characterized by rounded corners and a flexible construction which allows it to adapt to the actual coil shape during use. Additionally, its flexibility and general shape allow it to be moved, as by dragging, in order to minimize its being caught on obstacles or being subject to tearing. This is especially important when very long lengths of cable are to be dispensed to remote and difficultly accessable locations, such as the wiring of circuits in ceilings and walls.

Figure 2:
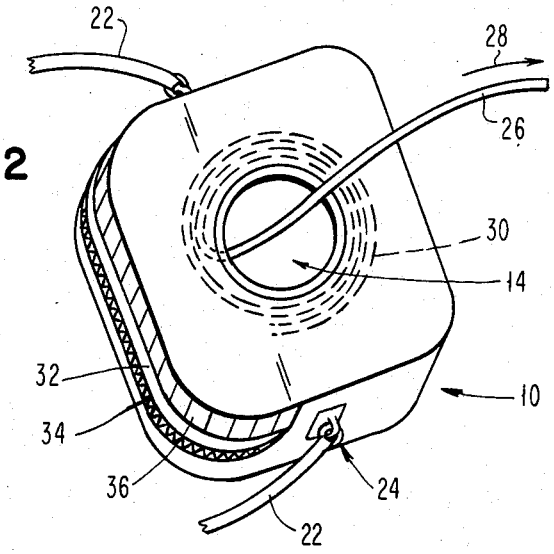
FIG. 2 is another view of the present container/dispenser, illustrating the placement of a coil of electrical cable therein, and the dispensing of this cable from a central payout opening.

FIG. 2 illustrates the use of the container/dispenser 10 wherein an electrical cable 26 is withdrawn in the direction of arrow 28. The coil of electrical cable is indicated by the dashed lines 30 in container/dispenser 10.

In operation, an opening 32 is made by separating the velcro-layered flaps 34 and 36. Opening 32 is sufficiently wide to allow the ready placement of a coil of electrical cable into the center of container/dispenser 10, and the reinforced opening 14 is sufficiently wide to allow easy exit of cable 26. Typically, the diameter of exit opening 14 is approximately 2–4 inches, although this can be varied. The minimum size of opening 14 is such that heavy electrical cable 26 can be easily dispensed regardless of the length of coil 30 within the container/dispenser 10, but not so great that more than one strand of cable will be extracted at any one time, regardless of the length of the coil 30 located in container/dispenser 10.

In actual practice, container/dispenser 10 is easy to use and can be subjected to very rough treatment without tearing and/or binding in any way. Further, it is possible to pick up and carry container/dispenser 10 with one hand, whether it is carried by the strap 22 or by holding it at another location, as for instance the reinforced opening 14. During actual use, an electrician can easily pick up and carry container 10 to any location due to the flexibility of this container. Because the opening 14 is reinforced, carrying the container 10 in this manner wil not lead to tearing.

An noted, container/dispenser 10 is specifically designed for rough use and reuseable operation, even though the material to be transported and dispensed is heavy and stiff.

Still further, it is made for very rapid use with but a single hand, which is important for electricians who must often work under awkward conditions and with only one free hand. These advantages result from the unitary construction using strong, flexible materials, and the general shape of the container/dispenser 10, both when it is filled with a full coil of electrical cable, and when only a small amount of cable is in the container. When the container/dispenser 10 is not in use, it can be easily folded for shelf storage.

Although the invention has been illustrated by particular embodiments thereof, it will be apparent to those of skill in the art that some variations can be made therein without departing from the spirit and scope of the present invention. However, the specific design described herein yields superior results in terms of reuseability, durability, and ease of actual use under adverse operating conditions.

Having thus described our invention, what we claim as new and desire to secure as Letters Patent is:

1. A non-rigid and reusable dispensing device for containing and dispensing plastic or rubber coated electrical cable, comprising (a) a container made of unitary flaccid durable sheet material constructed and sized to receive a coil of said cable, the container having generally parallel, non-perforated front and back facing walls and having a side wall connected to the entire periphery of each of said facing walls, said side wall extending between the facing walls, at least one of said facing walls having a dispensing opening sized for dispensing cable and being located substantially in the center of said one facing wall, said side wall having a closable opening of sufficient length and width to receive therethrough said coil of cable without tangling, (b) means for fastening and unfastening said closable opening, (c) carrying strap attaching means located adjacent opposite ends of said closable opening for attaching to said side wall a carrying strap.

2. The device of claim 1, further including a carrying strap.

3. The device of claim 2, where said container has a shape generally characterized by the absence of sharp right angle corners along said side wall, said dispensing opening being reinforced and said material being sufficiently flaccid that said container is foldable when not carrying said coil.

4. The device of claim 1, where said container has a shape generally characterized by the absence of sharp right angle corners along the periphery of said side wall.

5. The device of claim 1, where said dispensing opening is reinforced.

6. The device of claim 1, where said material is sufficiently flexible to be foldable when not carrying said coil.

* * * * *